United States Patent [19]

Sharp

[11] 4,009,808

[45] Mar. 1, 1977

[54] BABY PACK

[76] Inventor: Andrea H. Sharp, 2276 Kincaid St., Eugene, Oreg. 97405

[22] Filed: July 7, 1975

[21] Appl. No.: 593,766

[52] U.S. Cl. ..... 224/6

[51] Int. Cl.[2] ..... A47D 13/02

[58] Field of Search ..... 224/6, 8 R; 297/385, 297/392

[56] References Cited

UNITED STATES PATENTS

| | | | |
|---|---|---|---|
| 3,162,343 | 12/1964 | Anderson | 224/6 |
| 3,197,100 | 7/1965 | Thompson | 224/6 |
| 3,481,517 | 12/1969 | Aukerman | 224/6 |
| 3,780,919 | 12/1973 | Hansson | 224/6 |
| 3,871,562 | 3/1975 | Grenier | 224/6 |

FOREIGN PATENTS OR APPLICATIONS

| | | | |
|---|---|---|---|
| 540,672 | 10/1941 | United Kingdom | 224/6 |

*Primary Examiner*—Albert J. Makay
*Assistant Examiner*—Randolph A. Reese
*Attorney, Agent, or Firm*—Francis Swanson

[57] ABSTRACT

A carrying device for transporting an infant child is disclosed. The carrier may be worn on the user's back or may alternately be fitted to the user so that the infant is carried in front. The carrier includes a pair of adjustable shoulder straps to be worn by the user and also has an adjustable waist band. The outer jacket of the carrier is formed of heavy fabric such as canvas or twill and has an adjustable head support at its upper end. Inside the carrier is a seat-member which may be lowered as the baby grows taller so that the child's head is always in a position for proper support.

7 Claims, 4 Drawing Figures

BABY PACK

BACKGROUND OF THE INVENTION

1. Field of the Invention

The invention relates to infant carriers in general and more particularly those providing head support and which are adjustable to compensate for changes in body size as a child grows.

3. Description of the Prior Art

Numerous child-carrying devices exist in the prior art. Some simply comprise a rigid plastic seat with handles. These are used primarily for carrying very small infants in automobiles or over very short distances. They are generally unsuited to carrying larger children. Others have a rigid metal frame and are designed to be worn on the mother's back. The baby is carried in a fabric or plastic seat mounted on the metal frame. The seat has a pair of holes through which the infant's legs extend. Still others are made entirely of fabric and have a pouch in which the infant is carried. Some of these carriers may be worn on the front or back of the user's body. Support is provided by a pair of shoulder straps. One such carrier is shown in U.S. Pat. No. 3,780,919.

SUMMARY OF THE INVENTION

A principle object of the invention is to provide a carrier having an adjustable head-support member which provides physical support for the infant's head from its shoulders along its neck to the base of its skull and up to the back of the head near the child's ears.

A further object of the present invention is to provide a carrier having an inner seat which is adjustable and removable to compensate for changes in a child's body size as it grows.

A further object of the present invention is to provide a carrier having an inner seat which will provide full support for an infant from its buttocks to its shoulder blades when the child is secured in the carrier.

Other objects and advantages of the present invention will be apparent to those skilled in the art.

DETAILED DESCRIPTION

Figure 2:
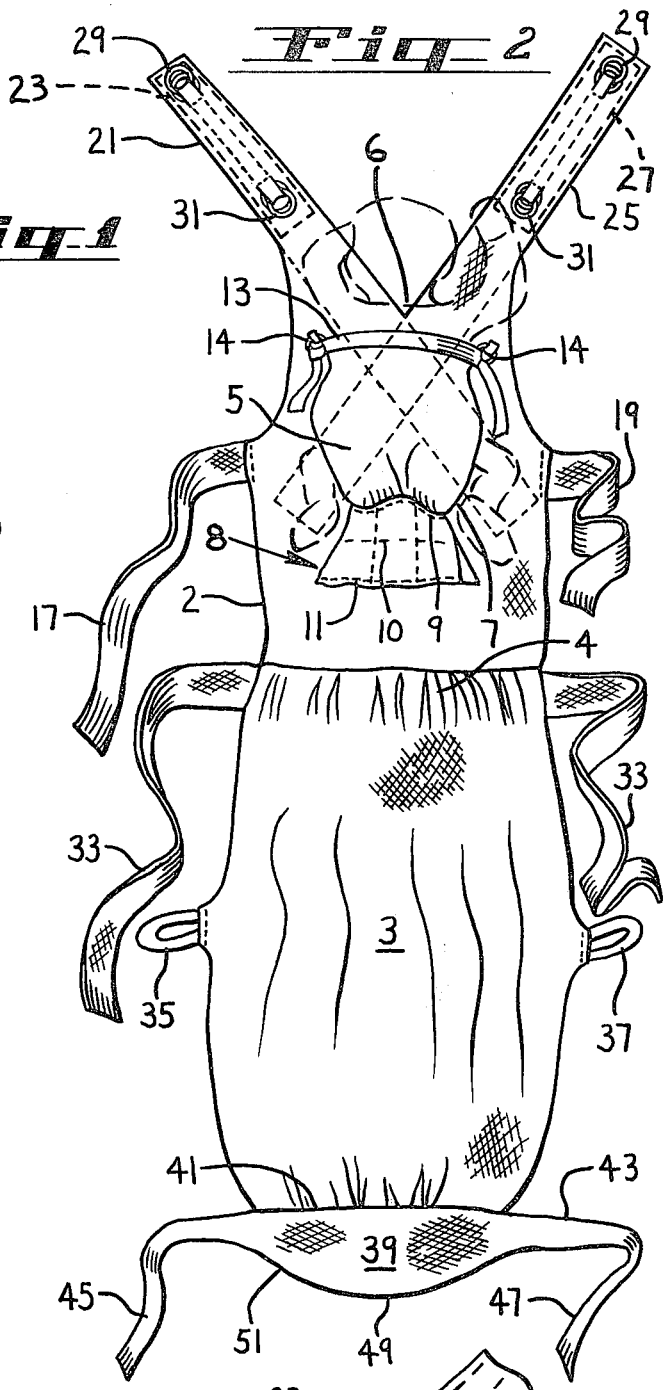
FIG. 2 is a plan view of the carrier as it would appear spread out on a flat surface. A small infant is shown positioned in the inner seat with the upper support strap in place.
Figure 3:
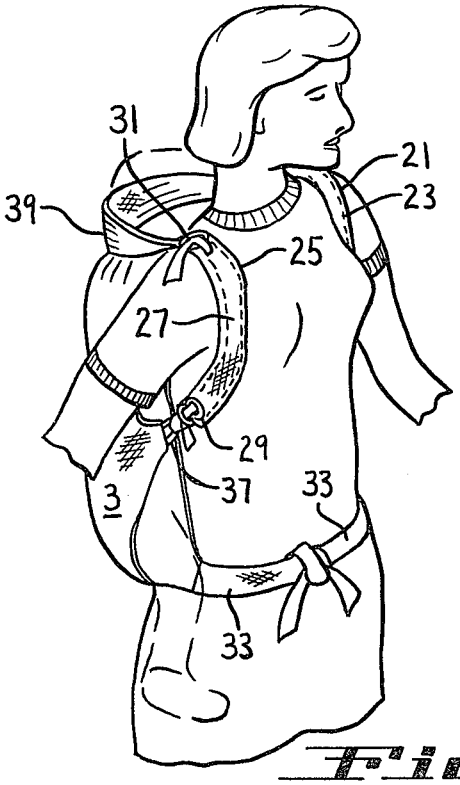
FIG. 3 is a perspective view as seen from a right frontal position showing the relation of the shoulder straps and waist band when the carrier is in place on the user.

Referring now to the drawings, FIG. 2 shows a plan view of the carrier which is composed of a front member (2) and a back member (3). The front member (2), back member (3) and the single piece waist band (33) are sewn together to form a floor (4). On the inside surface of the front member (2) is fastened an inner seat (5). The inner seat (5) is made of heavy fabric and is nominally hour-glass shaped; being wide at the top and bottom and having a narrow section (7) in the middle. The narrow section (7) and outwardly tapering wide bottom (8) of the seat (5) are secured to the inside of the front member (2) with a plurality of stitched seams (9), (10) and (11). A support strap (13) is sewn to the upper end of inner seat (5). Retaining rings (14) are sewn to the inner surface of front member (2) to provide adjustable fastening means used in conjunction with strap (13). A left underarm strap (17) and a right underarm strap (19) are connected at opposite edges in approximately the middle of the front member (2). A left shoulder strap (21) having a fixed shoulder pad (23) and a right shoulder strap (25) having a fixed shoulder pad (27) are sewn to and extend from the upper end of front member (2). Shoulder straps (21) and (25) are sewn to the front member (2) so as to cross each other and form an "X" configuration. This adds strength and eliminates rip-out in this area when the pack is being put on by the user. The two straps (21) and (25) form a "V" where they cross and are joined to front member (2). Underarm strap retaining rings (29) are mounted at the outer ends of shoulder pads (23) and (27). Head strap retaining rings (31) are mounted on the shoulder straps (21) and (25) near the upper end of front member (2). A single piece waist band (33) is stitched into and integral with the seam which joins front member (2) and back member (3) to form the pack floor (4). It will be recognized to those skilled in the art that a two-piece waist band might be chosen as an alternate construction. A left arm strap loop (35) is mounted on the left edge of back member (3) normally half way between the top and bottom of the back member (3). A similar right underarm strap loop (37) is mounted in a similar position along the right edge of back member (3). A head support (39) is joined to the upper end of back member (3) at seam (41). Head support (39) is formed of a single piece having a straight bottom edge (43). Support (39) is cut to form a thin left head support strap (45) and a right head support strap (47). Head support (39) gradually widens the outer ends of strap (45) and (47) toward the middle to form a broad center section (49) having a symmetrical curved upper edge (51). The head support (39) is interfaced with strong, but pliable, material for added support.

USE OF THE CARRIER

Figure 1:
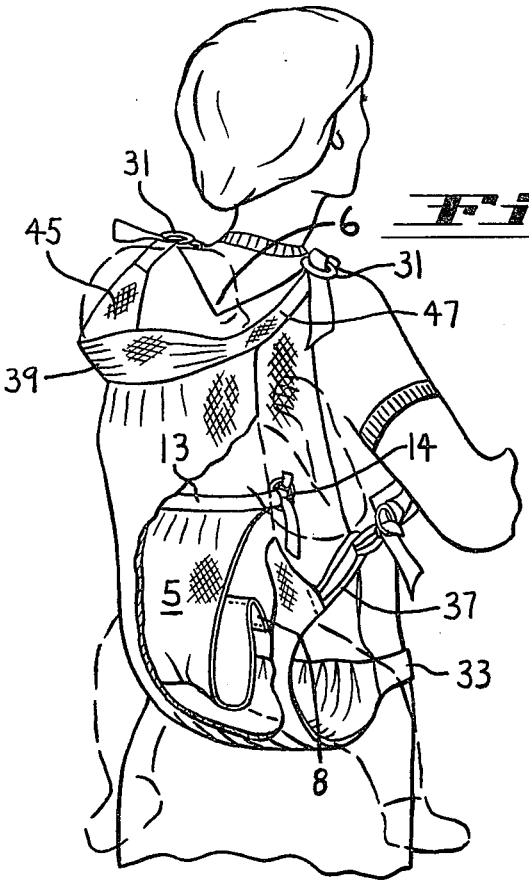
FIG. 1 is a perspective view of the carrier shown in place on the user's back. A larger child is shown within the carrier and the figure is partially broken away to show the interior construction of the carrier.

FIG. 2 illustrates the use of the carrier with a small, very young infant. The carrier is placed on a flat surface, unfolded and spread out. The infant is placed on front member (2) and the inner seat (5) folded over the child's body. The support strap (13) is positioned across the infant's upper back; in the figure, just below the arm pits. Strap (13) is now fastened to retaining rings (14). It will be appreciated that because of the nature of this construction, rings (14) and straps (13) may be adjusted to accommodate both large and small infants securely and confortably. It is contemplated that the back and buttocks of a small infant will be supported by the narrow section (7). However, as the infant grows larger, seams (9), (10) and (11) may be progressively removed so that an increasingly wide portion of the bottom section (8) becomes available to support the child's buttocks and back as the child increases in size. As the child grows taller, this ability to adjust the seating position downward allows the head to always be properly supported by the cup-like head support (39). It will be appreciated that eventually the inner seat (5) may be completely removed and the child will sit on the floor (4). With the infant securely positioned in the inner seat (5), the back member (3) is folded up over the child. Head support (39) is positioned about the child's shoulders so that center section (49) extends upward along the child's neck and the base of the skull. As illustrated in FIG. 1, curved edge (51) is then at the back of the head near the level of the infant's ears. This will vary somewhat with infant size and the position of the carrier on the user. Left and right head support straps (45) and (47) respectively are then joined to head support rings (31) and adjusted to a length suitable to provide proper support for the child's head.

When properly positioned, head support (39) provides a strong, pliable cup-like structure which will support the child's head from his neck up the base of the skull to the lower back of the head. Lateral support of the head is also provided by center section (49) and straps (45) and (47). Head support (39) may be adjusted to bring the child's head close to the user's back. For larger children, support (39) may be adjusted away from the user's back to provide for extra freedom of movement.

Figure 4:
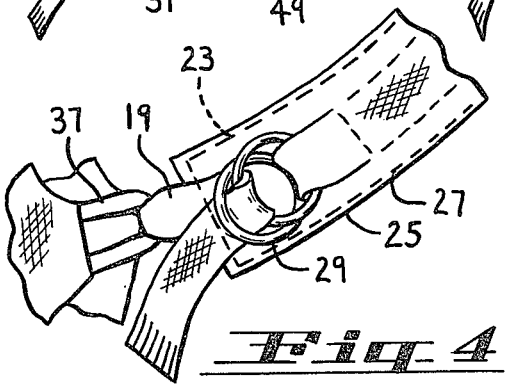
FIG. 4 illustrates the use of the shoulder strap retaining rings.

The shoulder straps are operatively connected as follows. Left underarm strap (17) is passed through left underarm loop (35) and joined to shoulder strap retaining rings (29) located at the end of the left shoulder strap (21). Right shoulder strap (19) is similarly passed through right underarm loop (37) and joined to retaining rings (29) at the outer end of right shoulder strap (19) as illustrated in FIG. 4. Underarm straps (17) and (19) in conjunction with loops (35) and (37) and shoulder straps (21) and (25) now form a pair of strong supporting members for the carrier. When straps (17) and (19) are drawn up they pull back member (3) in toward front member (2) to form a secure outer pouch. The user simply slips his arms through the harness formed by these loops in the same manner as one slips on a jacket. Shoulder straps (21) and (25) may be adjusted by repositioning underarm straps (17) and (19) and retaining rings (29). When the carrier is comfortably in place, pads (23) and (27) will bear against the user's shoulders and distribute the load evenly across the shoulder areas. With the carrier in place on the user's back, waist strap (33) is tied around the user's hips or upper waist and helps to transfer some of the weight of the carrier to the user's hips.

The position of the infant on the user's back may be adjusted by shifting the infant's weight and lengthening or shortening the underarm straps (17) and (19) to elevate the position of the infant. Straps (17) and (19) are pulled further out through retaining rings (29). To position the infant lower on the user's back, the reverse is true.

It is readily apparent that the carrier may be worn in front of the user's body. To accomplish this, the user merely passes his arms through the loops formed by joining shoulder straps (21) and (25) to underarm straps (17) and (19) respectively. The carrier is then lifted into place against the user's chest and the waist strap (33) is tied behind the user's back at the hips or waist.

Having described the preferred embodiment of the invention it will be apparent to those skilled in the art that other modifications and arrangements may be made without departing from the true scope and spirit of the invention. For example, it would be readily apparent that the various retaining rings herein described could be replaced with buckles or other clasps and devices. Also, although the carrier is preferably made of a heavy fabric, it might alternately be made of plastic or have a mesh insert for warm climates. I claim as my invention all those modifications as come within the true spirit and scope of the appended claims.

I claim:

1. In combination, a shoulder supported child carrier, including an outer jacket having a front member and a back member;

a shoulder harness including first shoulder strap means having strap retaining means thereon, said strap means connected to the front member of the carrier;

plural loop means on the back member;

second shoulder strap means on the front member adapted to pass through the loop means and engage the strap retaining means;

wherein the improvement comprises:

a removable inner seat attached to the jacket comprising a wide upper portion having a strap attached thereto, a narrow center portion and a lower portion tapering from the narrow center to a wide bottom, the wide upper portion adapted to provide support to the back of a child carried within the seat and the narrow center and wide bottom defining means for adjusting the seat width to provide support for the lower back and buttocks of children of differing sizes, said adjusting means also comprising a plurality of seams securing the bottom of the seat to the outer jacket, said seams being selectively removable when the seat is adapted to hold a larger child.

2. The combination of claim 1 wherein the inner seat is completely removable so that the carrier will accommodate a relatively large child, the child then being supported within the jacket by the front and back members of the outer jacket.

3. The combination of claim 1 wherein the shoulder harness includes means for drawing the front member and the back member of the outer jacket together.

4. In combination, a shoulder supported child carrier, including an outer jacket having a front member and a back member;

a shoulder harness including first shoulder strap means having strap retaining means thereon, said strap means connected to the front member of the carrier;

plural loop means on the back member;

second shoulder strap means on the front member adapted to pass through the loop means and engage the strap retaining means;

wherein the improvement comprises:

an adjustable head support including a pair of narrow straps attachable to the strap retaining means so that the support surrounds a child's lower head, neck and cheeks and fastens to the retaining means in a substantially horizontal manner;

and an inner seat adjustable in width to provide an increasingly wide seat base so that support for the lower back and buttocks of children of differing sizes may be provided, the inner seat comprising a wide upper portion having a strap attached thereto, a narrow center portion, a lower portion tapering from the narrow center to a wider bottom, and adjustment means including a plurality of seams securing the bottom of the seat to the outer jacket, said seams being selectively removable when the seat is adapted to hold a larger child.

5. The combination of claim 4 wherein the first shoulder strap means comprises a pair of elongate bands having integral padding within one end, the bands being attached to the front member in angular relation to one another so as to define an acute angle at the top of the front member.

6. The combination of claim 4 wherein the head support forms a cup-like structure fitting around a child's neck and head to a point beyond the cheeks of the child's face when the child is positioned in the carrier and when the support is attached to the strap retaining means so that the narrow straps, when attached, further provide lateral support to the child's head.

7. A shoulder supported carrier for children comprising:

an outer jacket having a front member and a back member;

a removable inner seat having a wide upper portion, a narrow center portion and a wider bottom portion for holding a child, the wider bottom portion being downwardly adjustable by selective removal of a plurality of seams connecting the seat to the jacket to provide an increasingly wide buttocks and back support area with each downward adjustment, so that support for the back and buttocks of children of differing sizes may be provided;

a waist band connected to the outer jacket;

first shoulder strap means connected to the front member of the carrier;

first and second strap retainers mounted on the first shoulder strap means;

plural loop means on the back member;

second shoulder strap means on the front member adapted to pass through the loop means and engage the first strap retainers;

and adjustable head support means defining a wide center section, the center section tapering to form a pair of narrow support straps, the straps optionally connectable to the second strap retainers;

the head support forming a cup-like pocket to support a child's neck and the lower rear of the child's head and to further support the child's head along the sides of the child's face beyond the child's cheeks, when the support straps are attached to the strap retainers so that lateral support for the child's head, face and cheeks is provided at all times.

* * * * *